US005494552A

United States Patent [19]

Thompson

[11] Patent Number: 5,494,552

[45] Date of Patent: Feb. 27, 1996

[54] APPARATUS FOR APPLYING FUSIBLE ADHESIVE MEANS TO GARMENTS AND THE LIKE

[75] Inventor: George V. Thompson, Sussex, N.J.

[73] Assignee: Hoffman/New Yorker Incorporated, Paterson, N.J.

[21] Appl. No.: 210,420

[22] Filed: Mar. 18, 1994

Related U.S. Application Data

[63] Continuation of Ser. No. 107, Jan. 4, 1993, abandoned.

[51] Int. Cl.[6] ..... B32B 35/00; D06F 71/00; D06C 15/00

[52] U.S. Cl. ..... 156/475; 156/492; 156/580; 156/581; 156/583.1; 156/583.8; 38/20; 38/16; 38/36; 38/66; 38/71; 38/99; 100/214; 100/232; 100/295; 223/57; 223/70

[58] Field of Search ..... 38/2, 5, 14, 15, 38/16, 17, 20, 21, 23, 27, 28, 34, 35, 36, 43, 66, 71, 99, 144; 223/57, 70, 73, 76; 26/5, 6, DIG. 1; 156/475, 489, 492, 583.8, 583.9; 100/16, 214, 232, 233, 237, 295, 296

[56] References Cited

U.S. PATENT DOCUMENTS

| | | | |
|---|---|---|---|
| 739,838 | 9/1903 | Crow | 100/264 |
| 2,046,785 | 7/1936 | Malott, Jr. | 100/295 X |
| 2,058,953 | 10/1936 | Coleman | 38/66 X |
| 2,065,235 | 12/1936 | Matthews | 223/57 |
| 2,328,229 | 8/1943 | Pearson | 100/295 |
| 3,108,922 | 10/1963 | Possis et al. | 156/489 X |
| 4,300,296 | 11/1981 | Hockstrasser et al. | 38/17 |
| 5,075,989 | 12/1991 | Cartabbia | 223/57 X |

FOREIGN PATENT DOCUMENTS

| | | | |
|---|---|---|---|
| 2529236 | 12/1983 | France | 38/20 |
| 3025456 | 2/1982 | Germany | 38/15 |

*Primary Examiner*—David A. Simmons
*Assistant Examiner*—M. Curtis Mayes
*Attorney, Agent, or Firm*—Louis Weinstein

[57] ABSTRACT

Two-sided fusible tape is mounted in an effective manner upon the sleeve seam allowance of a garment comprising the steps of placing a jacket arranged inside out upon a heated stationary buck, the jacket being positioned on the buck so that the sleeve seam allowance is properly aligned. An exposed surface of a two-sided fusible strip is placed along the sleeve seam allowance, the other fusible surface being covered with a protective sheet. A vacuum communicating with the buck is drawn to retain the garment in the proper position. A pair of heated heads having pressing surfaces conforming to the shape of the buck are simultaneously driven toward the buck to press the fusible strip against the sleeve seam allowance of the garment, the heat from the buck and the heads activating the fusible. Steam may be ejected from the heads when the fusible employed requires steam for activation. The heads are withdrawn from the buck and the garment is removed in preparation for mounting a shoulder pad to the garment. A single drive assembly simultaneously moves the heads between their open and closed positions. Pivot arms supporting the heads are arranged in "criss-cross" fashion to minimize the space occupied by the drive mechanism and pivot arms, especially when in the open position. The heads substantially exactly conform to the contour of the buck and engage end to end without overlapping preventing distortion of the garment due to the application of the fusible.

34 Claims, 10 Drawing Sheets

APPARATUS FOR APPLYING FUSIBLE ADHESIVE MEANS TO GARMENTS AND THE LIKE

This is a continuation of application Ser. No. 08/000,107, filed Jan. 4, 1993 now abandoned.

FIELD OF THE INVENTION

The present invention relates to the field of applying shoulder pads and the like to garments, and more particularly, to a novel method and apparatus for simplifying the aforesaid operation through the application of a fusible tape to a garment employing the method and apparatus of the present invention.

BACKGROUND OF THE INVENTION

Shoulder pads are typically employed in garments, such as jackets, to provide fullness and to provide a proper shoulder appearance. One conventional method for applying a shoulder pad to a garment such as a jacket is by sewing the pad into position either manually or through the use of a sewing machine. Another alternative method is to fuse the pad in position by using a heat activated fusible glue.

The present state of the art in shoulder pad fusing typically employs shoulder pads having a fusible material impregnated into the lining of the pads. Heat is employed to melt the fusible material onto the garment, which heat is applied by way of a special machine which goes beyond the scope of the present application. This machine is typically referred to as a shoulder pad fusing machine.

The disadvantage of the above techniques which constitute the present state of the art is that they are not capable of being used with shoulder pads of the standard type, i.e. of the type which are not provided with any fusible material.

BRIEF DESCRIPTION OF THE INVENTION

The present invention discloses method and apparatus for use in conjunction with and preparatory to the operation of shoulder pad fusing machines. The method and apparatus of the present invention is utilized prior to operation of the shoulder pad fusing machine and accordingly prepares the garment for subsequent operations.

The method and apparatus of the present invention is characterized by enabling the use of standard shoulder pads not having fusible elements in the preparatory process.

The present invention allows the use of such standard shoulder pads to be employed in the subsequent operations performed by the shoulder pad fusing machine providing an economic advantage since fusible shoulder pads are more expensive than standard pads, and present problems which are avoided by using the method and apparatus of the present invention.

The method and apparatus of the present invention for application of the tape constitutes a significant improvement over the present state of the art by correcting a problem area. In the present state of the art in shoulder pad fusing, impressions are created on the outside of the garment where the fusible material is melted. The tape application machine of the present invention applies the fusible material to an area which differs from the attachment area of a jacket when employing conventional techniques, effectively eliminating the undesirable impression created through the use of the techniques presently employed. The present invention is characterized by applying the fusible material to an area referred to as the shoulder seam allowance, which allowance is usually of the order of 0.375 inches wide and constitutes the excess material beyond the stitch mark on a shoulder seam of a garment, such as a jacket. The undesirable impression is avoided through the method and apparatus of the present invention because the fusible tape is applied to an extra layer of material which is not in contact with the exposed outside material of the garment.

The tape employed in the present invention may be a standard two-sided fusible having a protective paper backing on one major surface.

The exposed side of the tape is placed on the garment.

The apparatus utilized to perform the method of the present invention comprises a support frame supporting a stationary lower pressing surface referred to as a buck. The buck has a contoured surface which conforms to the desired shape of a shoulder. The garment is turned "inside-out" with the exterior shoulder portion of the garment resting upon the buck.

The buck is heated, preferably with live steam, which maintains padding on the buck dry. Vacuum means are also provided for maintaining the garment in the proper position on the buck during the application of the fusible material.

A pair of pressing heads operated by a common drive means are initially displaced from the buck and are simultaneously driven toward the buck. The dual driven heads have pressing surfaces which engage the garment and fusible, and substantially conform to associated portions of the buck supporting surface. The drive means causes the heads to simultaneously press the garment and fusible material between the heads and the buck, which eliminates any distortion of the garment.

Each head is heated preferably by steam and can further be provided with means for injecting live steam into the region in which the fusible material and garment are being joined. The application of steam through the heads is necessary in those instances where the fusibles being employed require steam to activate the fusing process.

The drive means for the heads, in one preferred embodiment, comprises a pair of meshing gears, one of which is driven and the other of which is a follower gear. The gears rotate in opposite directions and the gears and pressing heads are symmetrical about a center-line whereby the gear to the left of a machine center line is associated with a pressing head which is arranged to the right of the center-line and a gear to the right of the center-line is associated with a pressing head which is arranged to the left of the center-line. By reversing the gear/head connections in this "criss-cross" fashion, more effective use is made of the space occupied by the machine, especially when the pivot arms coupling the heads to their pivot shafts are in the open position. The gears, pivot arms and heads are symmetrical about the central vertical axis. The pivot arms are provided with clearance offsets to permit free, unobstructed movement of the pivot arms between the displaced and the closed positions.

The drive means provided is preferably an air cylinder coupled to a pivot arm which rotates a drive shaft upon which the driven gear is mounted to rotate. The air cylinder provides the necessary force for opening and closing the heads as well as providing sufficient force to press the fusible tape into position against the sleeve seam allowance of the garment.

The pivot arms and drive means collectively comprise engaging means for bringing each of the pressing heads into engagement with the buck so as to apply a pressure distributed substantially throughout the concave pressing surface of the pressing head to a fusible and a garment on the buck and comprise alignment means for causing adjacent ends of the concave pressing surfaces of the pressing heads to be come aligned with each other, to touch each other, and to touch the buck, all simultaneously with bringing each of the pressing heads into engagement with the buck, thereby preventing pinching or distortion of the fusible and the garment.

Since the present invention constitutes a new process and apparatus for performing the process, there are no devices or techniques known to the inventor which are capable of applying two-sided fusible tape to prepare a garment for a shoulder pad fusing operation. Machines currently in use, such as shoulder pad fusing machines, would require significant modification in order to apply the novel process of the present invention. Even so, such modified machines would be impractical and, in fact, would be inoperable for the following reasons:

State of the art shoulder pad fusing machines employ single or multiple pressing heads and stationary bucks to melt the fusible onto the garments.

Machines of this general type having single heads are inefficient and not practical for tape application because it is necessary to provide adequate pressure to a contoured shape. Machines with single pressing heads cannot apply adequate pressure and cannot provide uniform pressure evenly to the entire curved area where tape fusing is required. For example, directed vertical pressure cannot press horizontal areas effectively.

State of the art dual head presses for shoulder pad fusing are not practical for tape application because they are designed to press garments with a measure of overlap between the heads. This is undesirable, firstly, because it is a slow method in that one head must first close and then open before the next head closes, which presents an economic disadvantage. In addition, it is not a desirable technique because it causes distortion of the garment as material at the edges of the head will be pushed out.

To correct these problems the heads must be arranged so that they do not overlap and must be arranged to move so that they contact the buck simultaneously. Even assuming such modifications are capable of being made to the present state of the art dual head machines, the results will nevertheless be undesirable because such machines employ two pneumatic air cylinders to drive the heads making it extremely difficult to synchronize the heads so that they will simultaneously contact the buck.

Summarizing, the method steps of the present invention, which method steps are performed by the novel apparatus of the present invention, comprise the following:

A garment is turned "inside-out" and the shoulder portion is placed over the contoured supporting surface of a stationary buck.

The exposed surface of a piece of two-sided fusible tape is positioned upon the garment so that the exposed surface engages the garment. The strip of two-sided fusible is aligned to overlie the sleeve seam allowance.

A vacuum condition is initiated to maintain the garment and two-sided fusible strip in their proper positions. Alternatively, the vacuum condition may be initiated immediately upon proper placement of the garment upon the buck.

The dual head drive means is activated causing the heads to simultaneously engage the fusible strip and garment whereupon the simultaneous engagement and the equal pressure applied by the heads upon the garment and fusible strip assures that the fusible strip will be properly and uniformly pressed into place without causing any distortion of either the garment or the fusible strip. The adjacent edges of the pressing head touch in the closed position to prevent distortion of the garment.

The heads are then displaced from the pressing position. The paper backing on the covered fusible surface may then be removed, exposing the non-fused side of the tape which may then be fused to the shoulder pad on a conventional shoulder pad fusing machine.

This novel method enables the application of the fusible in a precision manner so as to be applied only to the sleeve seam allowance, which fusible is applied using a novel technique to prevent distortion of the garment as well as preventing creation of impressions upon the outside of the garment where the fusible is melted and further permitting the use of standard shoulder pads which do not have fusible material impregnated therein (or thereon).

The apparatus utilized to perform the novel process steps of the present invention is characterized by utilizing a dual head mounting and driving apparatus with pivot arms arranged in a "criss-cross" fashion to significantly reduce the space required for the machine used to apply the fusible.

OBJECTS OF THE INVENTION

It is, therefore, one object of the present invention to provide a novel method and apparatus for affixing fusibles and the like to garments and which permits the utilization of standard shoulder pads which do not have fusible material impregnated therein.

Still another object of the present invention is to provide a novel method and apparatus for preparing a garment for affixing a shoulder pad thereto in which dual heads are utilized in a unique manner to adhere a fusible to the garment.

Still another object of the present invention is to provide a novel method and apparatus for preparing garments preparatory to applying a shoulder pad wherein the fusible material utilized for joining the shoulder pad to the garment is applied in the form of a two-sided fusible strip which is precisely aligned upon the garment sleeve seam allowance to prevent the occurrence of unsightly impressions encountered when utilizing conventional techniques.

Still another object of the present invention is to provide a novel apparatus for applying a fusible to a garment preparatory to the application of a shoulder pad, said apparatus utilizing a dual head arrangement and common drive means.

Still another object of the present invention is to provide a novel apparatus for applying a fusible to a garment preparatory to the application of a shoulder pad, said apparatus utilizing a dual head arrangement and common drive means wherein said dual heads are joined to a pair of mounting arms which are arranged in a "criss-cross" fashion when the heads are in the open position and wherein the heads are rotated in reverse directions to provide the desired fusible application pressure whereby the machine design significantly reduces the required operating space.

Still another object of the present invention is to provide a novel apparatus for applying a fusible to a garment preparatory to the application of a shoulder pad, said apparatus utilizing a dual head arrangement and common drive means wherein steam application means are provided for activating the fusible, when necessary.

Still another object of the present invention is to provide a novel apparatus for applying a fusible to a garment preparatory to the application of a shoulder pad, said apparatus utilizing a dual head arrangement and common drive means wherein the dual heads are arranged so as to simultaneously apply uniform pressure to the fusible and garment in a non-overlapping manner to prevent distortion of both the fusible and the garment.

BRIEF DESCRIPTION OF THE FIGURES

The above, as well as other objects of the invention, will become apparent when reading the accompanying description and drawings in which.

DETAILED DESCRIPTION OF THE INVENTION AND PREFERRED EMBODIMENTS THEREOF

Figure 1:
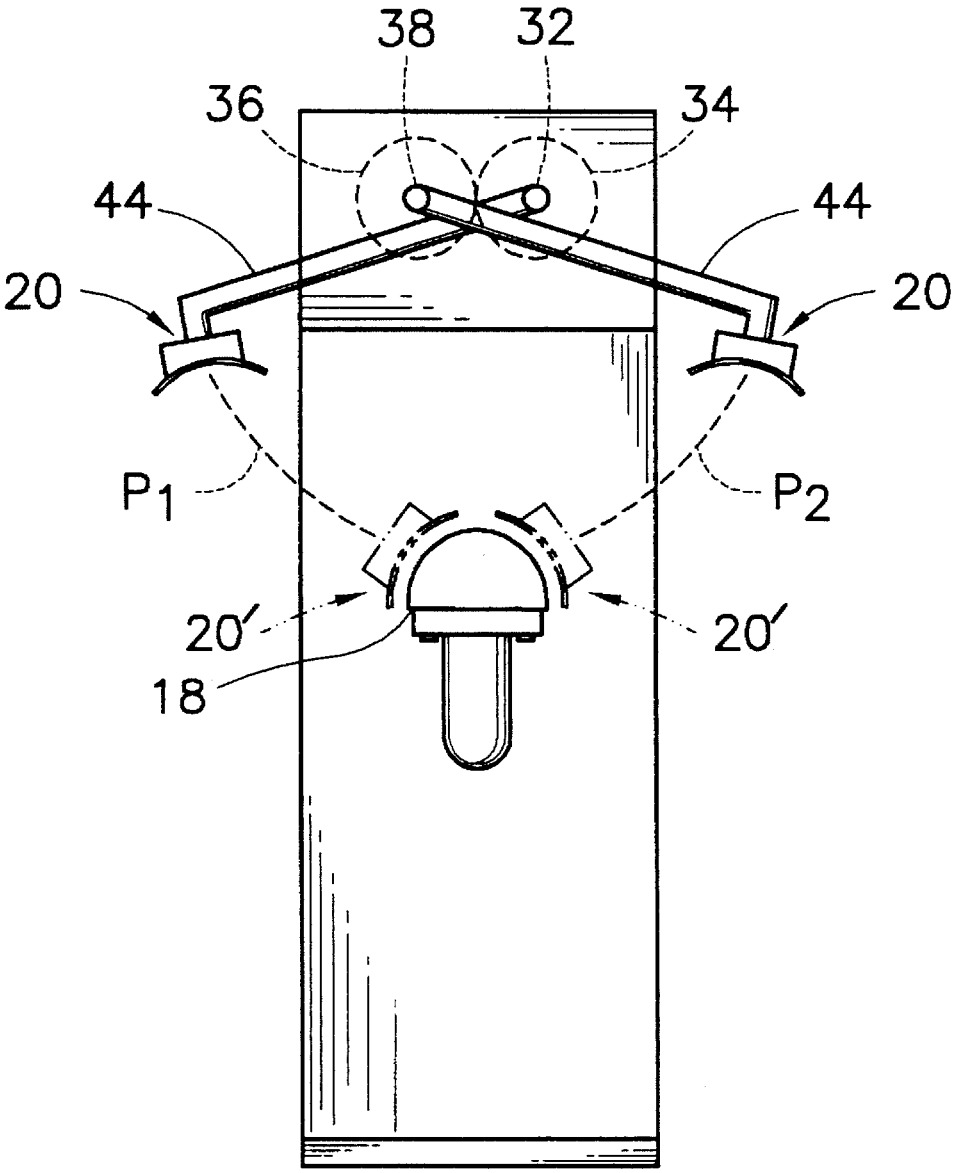
FIG. 1 shows an elevational view of apparatus designed to perform the novel method of the present invention.
Figure 1A:
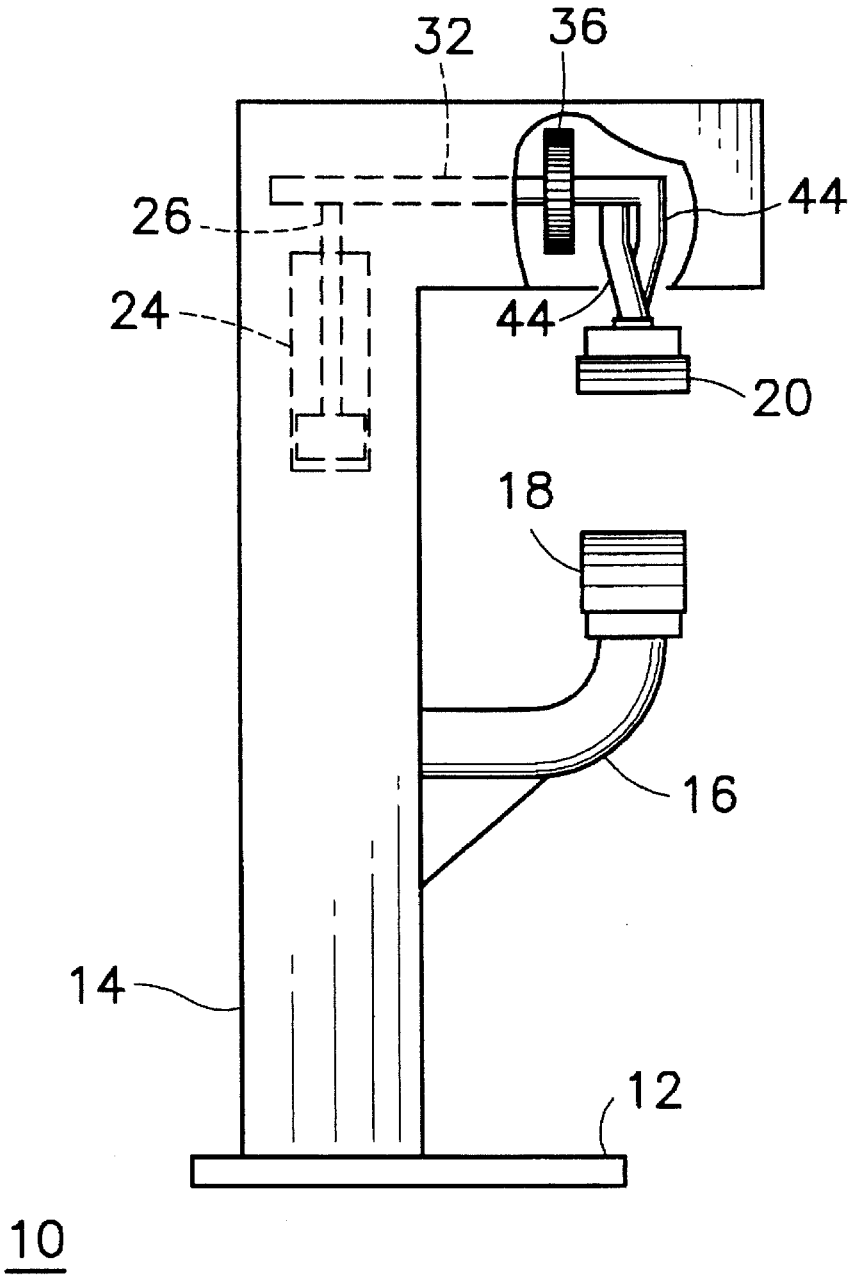
FIG. 1*a* shows a side view of the apparatus of FIG. 1.

FIGS. 1 and 1*a* show apparatus 10 for affixing a two-sided fusible in accordance with the novel technique of the present invention, and which is comprised of a base 12 for supporting an upright housing 14. A buck support 16 is secured to the upright housing 14 and is provided with a buck 18 shown in greater detail in FIG. 3. As will be described hereinbelow, buck 18 supports a shoulder of a jacket (turned inside out) during the application of a two-sided fusible thereto.

Figure 3:
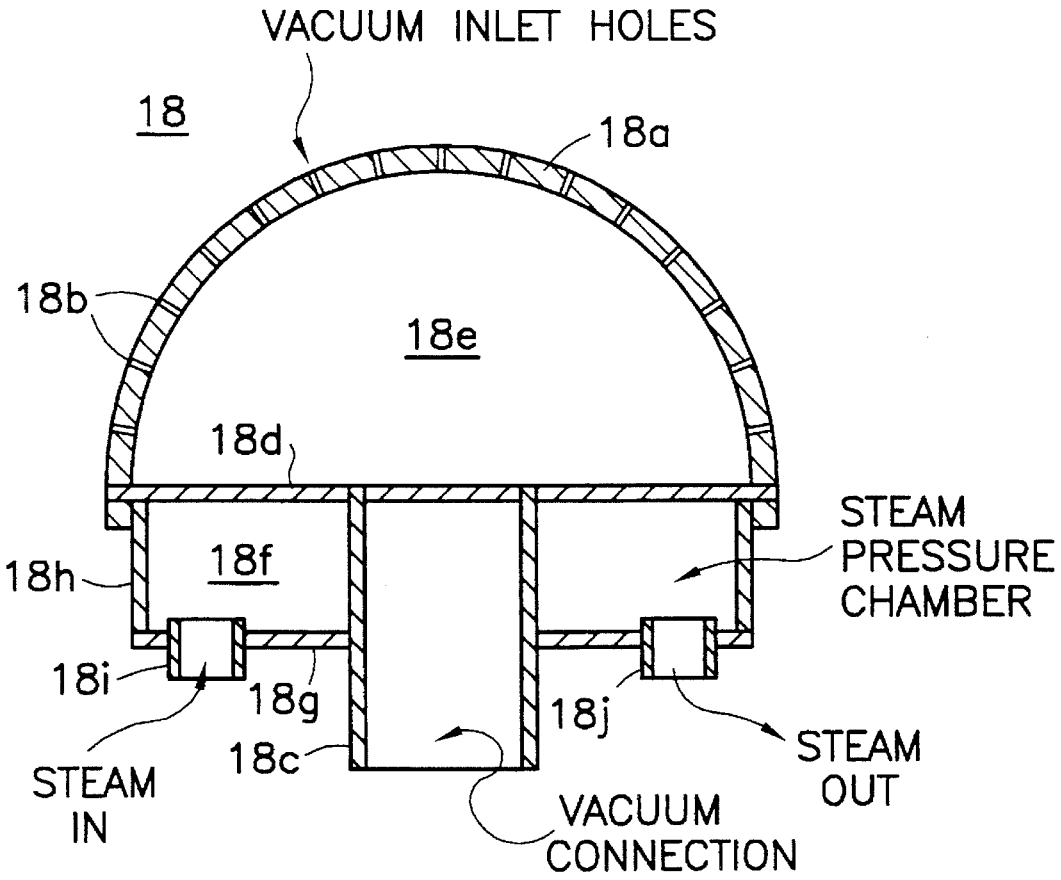
FIG. 3 shows an enlarged cross-sectional view of the buck employed in the apparatus of FIG. 1.

An enlarged, sectional view of buck 18 is shown in FIG. 3, which is further comprised of a curved plate 18*a* having a convex, outer surface, which retains a jacket shoulder in the proper shape and orientation throughout the application of a two-sided fusible. Plate 18*a* is formed of a suitable conductive metallic material, and is provided with a plurality of vacuum inlet openings 18*b* over substantially the entire surface thereof (only selected ones of the openings being shown in FIG. 3 for purposes of simplicity).

A substantially cylindrical-shaped, hollow vacuum connection 18*c*, only a portion of which is shown for purposes of simplicity, communicates between a central opening provided in conductive divider plate 18*d* and a suitable vacuum source (not shown) draws a vacuum within hollow chamber 18*e*, which serves to draw the jacket shoulder against buck 18 during the application of a fusible.

A chamber 18*f* surrounds cylindrical member 18*c* and is a substantially toroidal shaped chamber defined by conductive plate 18*d*, a similar conductive plate 18*g*, and a large diameter, circular conductive plate 18*h*. Plate 18*g* is provided with openings for receiving tubular connectors 18*i* and 18*j*, only portions of which are shown, which tubes are respectively connected to a steam source and a steam outlet. Steam introduced into chamber 18*f* heats all of the members 18*a*, 18*d*, 18*h*, 18*c* and 18*g* by conduction. Heated member 18*a* serves to maintain the garment and a pad (not shown) covering buck 18 dry and aids in the activation of the fusible so that it properly adheres to the sleeve seam allowance, as will be set forth in greater detail hereinbelow.

A pair of heads 20, 20 cooperate with buck 18 to uniformly press the two-sided fusible against the jacket shoulder, and specifically the shoulder seam allowance, as will be described hereinbelow in greater detail.

Each of the head assemblies 20, 20 are moved between a solid line position 20, 20 displaced from buck 18 to a dotted line position 20', 20' engaging the fusible and pressing the fusible against a shoulder of a garment positioned on buck 18. Mechanism 22 for moving the heads 20, 20 comprises an air cylinder 24 for operating piston 26 in a reciprocating manner, as will be more fully described. A pivot arm 28 has a pair of bifurcated arm portions 29, 30 with the gap therebetween terminating at the inward end in a substantially circular opening 31 receiving driven gear shaft 32, which supports driven gear 34. The right-hand end of pivot arm 28 is pivotally connected to piston rod 26 by pivot assembly 36. Driven gear 34 meshes with cooperating gear 36 mounted to rotate upon shaft 38.

Figure 4:
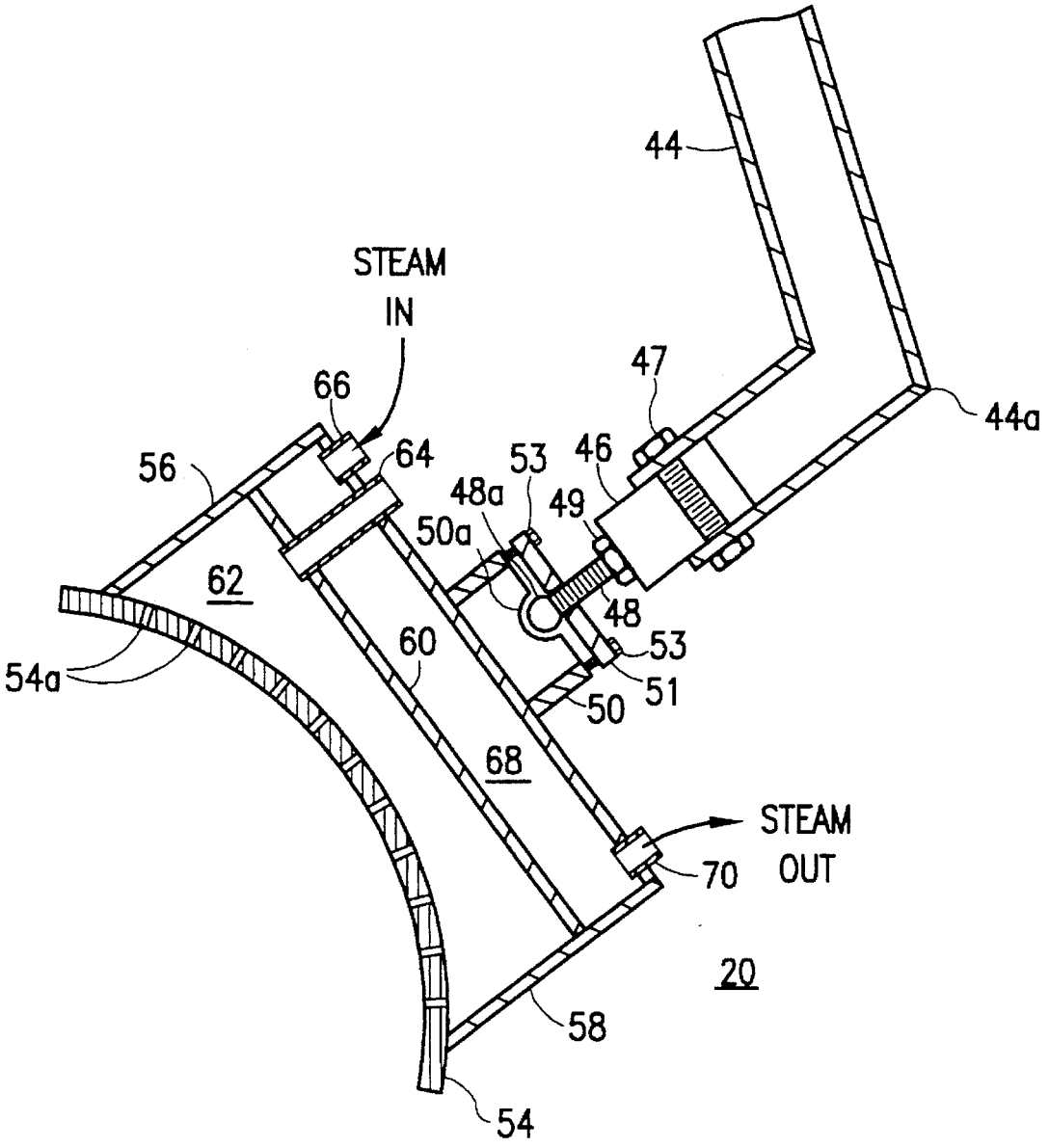
FIG. 4 shows an enlarged sectional view of one of the heads employed in the apparatus of FIG. 1.
Figure 4A:
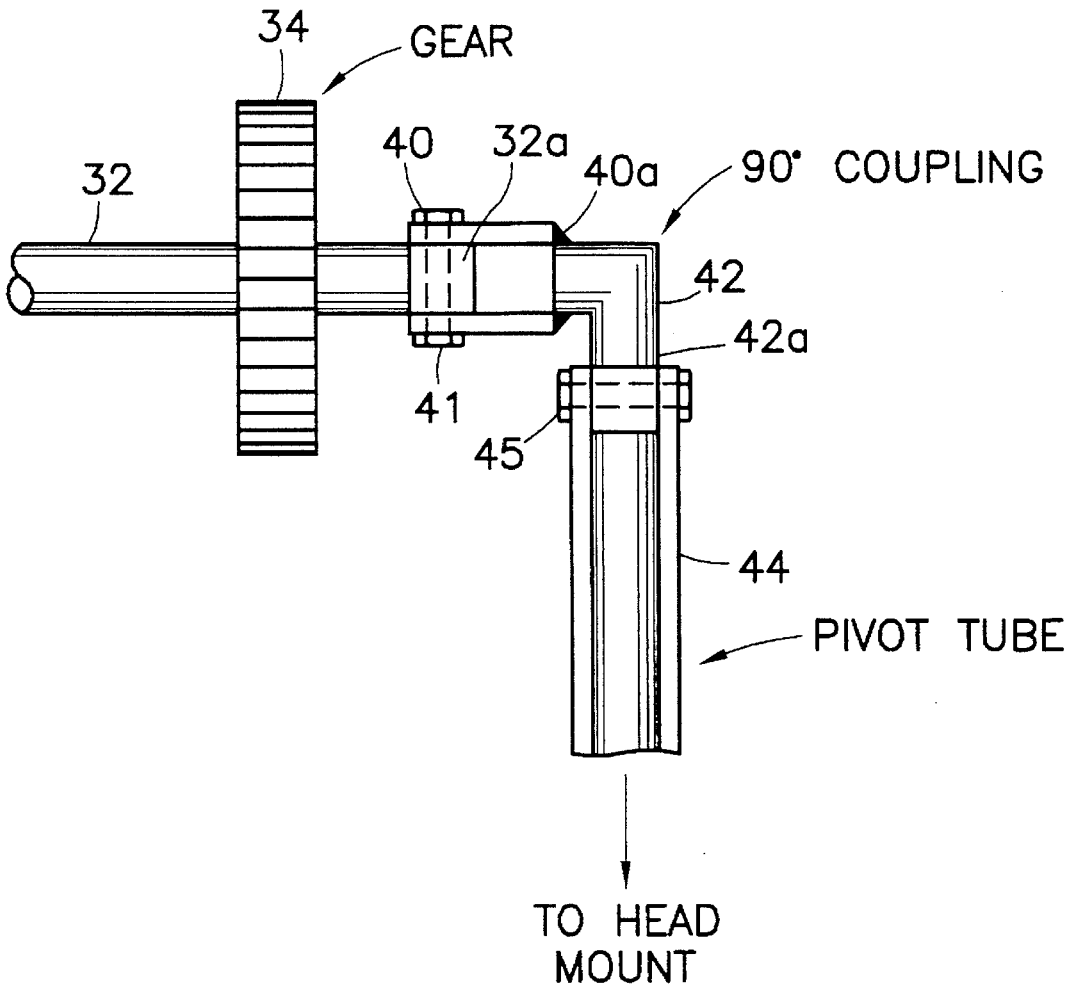
FIG. 4*a* shows an enlarged view, partially sectionalized, of the manner in which the pivot tube supporting a head of the type shown in FIGS. 1 and 4 is coupled to its associated gear shaft.

FIGS. 4 and 4*a* show the detailed structure of a typical head 20, and the manner in which it is mounted. Considering FIG. 4*a*, the right-hand end of shaft 32 terminates in a square end 32*a*. A shaft coupling 40 has its right-hand end 40*a* welded to an angle arm 42. The left-hand end of coupling 40 telescopingly receives the right-hand square-shaped end 32*a* of shaft 32. Fastener 41 secures the coupling 40 to shaft 32. A square-shaped hollow pivot tube 44 receives the downwardly extending arm 42*a* of angle 42, and is secured thereto by fasteners 45. As shown in FIG. 4, pivot tube 44 is bent at 44*a* a predetermined distance inward from the lower end of the pivot tube, which is coupled to a head assembly 20. A square-shaped rod 46 is telescopingly received within the lower end of pivot tube 44, and is secured in place by fastener 47. A threaded member 48 threadedly engages rod segment 46. Fastener 49 locks threaded member 48 in position to achieve the desired displacement distance between pivot tube 44 and head assembly 20, to correct for any "play" in the cooperating gears 34, 36.

The free end of threaded member 48 terminates in a ball-shaped head 48*a*. Ball-shaped head 48*a* forms a ball and socket assembly with a block 50 secured to plate 52 forming an integral part of head assembly 20. Block 50 is provided with a substantially hemispherical-shaped recess 50*a* for slidably receiving and supporting head 48*a*. Disc-shaped member 51 is secured to the outer surface of block 50 by fasteners 53. Disc-shaped member 51 and block 50 collectively serve as the "socket" of the ball and socket assembly. By suitably tightening fasteners 53, the desired orientation of head-assembly 20 relative to pivot tube 44 is obtained.

Head assembly 20 is comprised of a conductive plate 54 having a plurality of apertures 54*a* serving to emit steam delivered thereto. Plate 54 has a curved concave pressing surface, which 10 conforms to a portion (substantially one-half) of the convex surface of buck 18 defined by plate 18*a*.

Side wall plates, such as plates 56 and 58, define the side walls of head assembly 20 and are integrally joined to rear plate 52 and plate 54, for example, by welding. The hollow interior defined by plates 52, 54, 56 and 58 is divided into two chambers by barrier plate 60. All of the aforementioned plates are formed of a suitable conductive metallic material. Chamber 62 comprises a spray steam chamber, which receives spray steam through an opening provided in barrier wall 60. Spray steam inlet tube 64 extends through an opening in rear plate 52 and plate 60 to deliver steam to spray steam chamber 62 which escapes through steam holes 54*a* to activate the fusible, as will be more fully described.

Rear plate 52 is provided with an opening which receives a second steam inlet tube 66 for delivering steam into steam chamber 68. Steam delivered into chamber 68 heats the head assembly and especially plate 54 by conductive heating. Steam delivered to chamber 68 escapes from the chamber through a steam outlet tube 70.

It should be understood that both head assemblies 20, 20 are substantially identical in design and function and hence a description of only one of said head assemblies has been provided hereinabove for purposes of simplicity.

Figure 5:
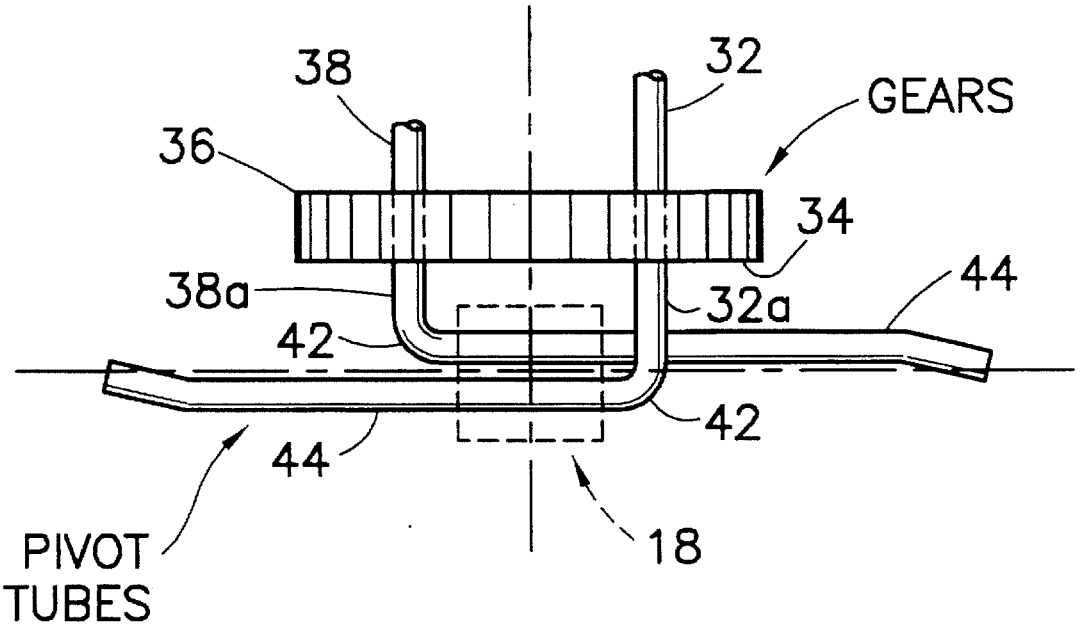
FIG. 5 shows a partial top view of the drive mechanism employed in the apparatus of FIG. 1.

FIG. 5 shows a simplified top plan view of the head drive assembly which is useful in understanding the manner in which the pivot tubes are arranged to permit unobstructed movement of heads 20, 20. As shown in FIG. 5, the lengths of shafts 32 and 38 extending outwardly from gears 34 and 36 are selected to be different so that the pivot tubes 44, 44 may be moved in an unobstructed fashion. This can best be understood from a consideration of FIGS. 1 and 5. The pivot tubes 44, 44 cross over one another in such a manner that the pivot tube 44 coupled to right-hand shaft 32 extends generally to the left and downwardly throughout its entire range of motion. The pivot tube 44 joined to left-hand shaft 38 extends generally downwardly and to the right throughout its entire range of motion, the paths of heads 20, 20 being shown by curved dotted lines $P_1$ and $P_2$ in FIG. 1. The arrangement of the drive mechanism, heads and pivot tubes is symmetrical about centerline C1 shown in FIG. 5. The movement of pivot tubes 44, 44 from the position 20, 20 to the position 20', 20' is substantially unobstructed due to the offset arrangement of the pivot tubes, which can best be appreciated from FIGS. 1*a* and 5.

A brief background of the manner in which shoulder pads are arranged in a garment will serve to facilitate a better understanding of the present invention.

Figure 6:
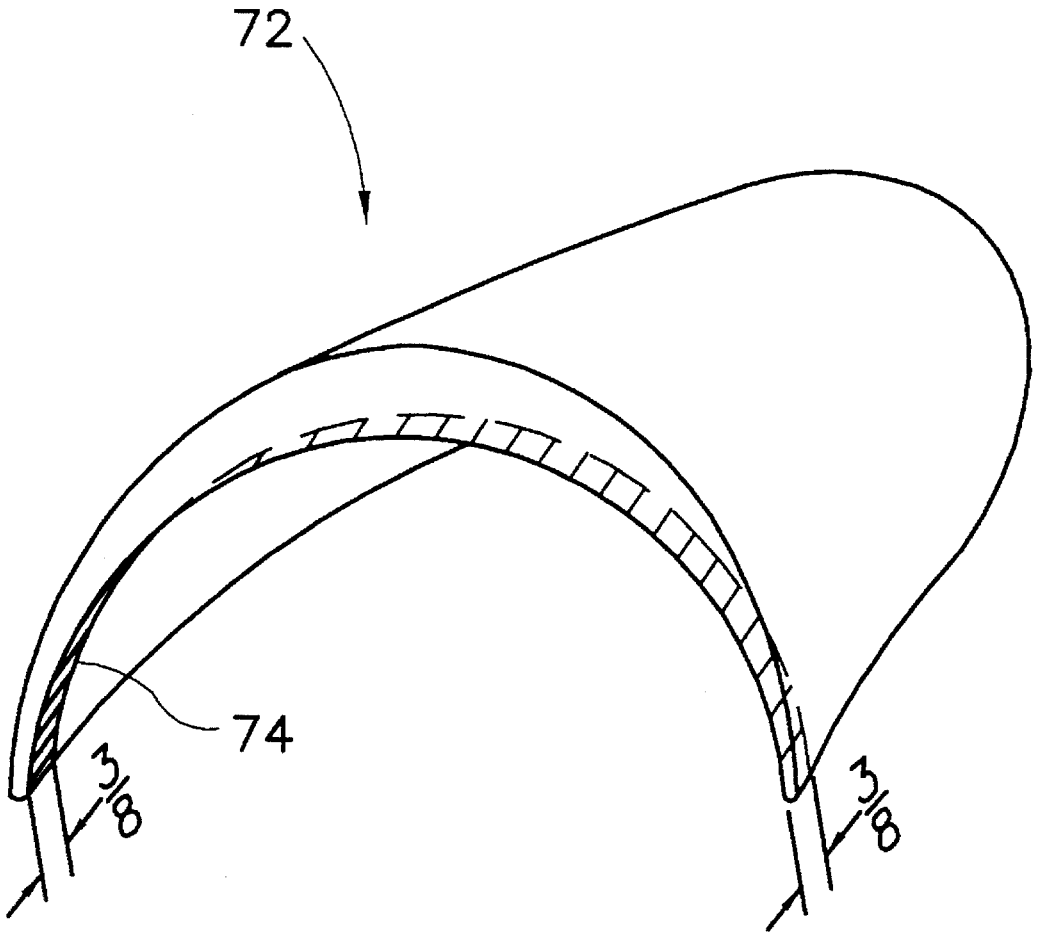
FIG. 6 is a perspective view showing a typical shoulder pad.

FIG. 6 shows a typical shoulder pad 72. The cross-hatched area 74 represents the narrow elongated region where the fusible material is provided, i.e. along the concave curved surface thereof.

Figure 6A:
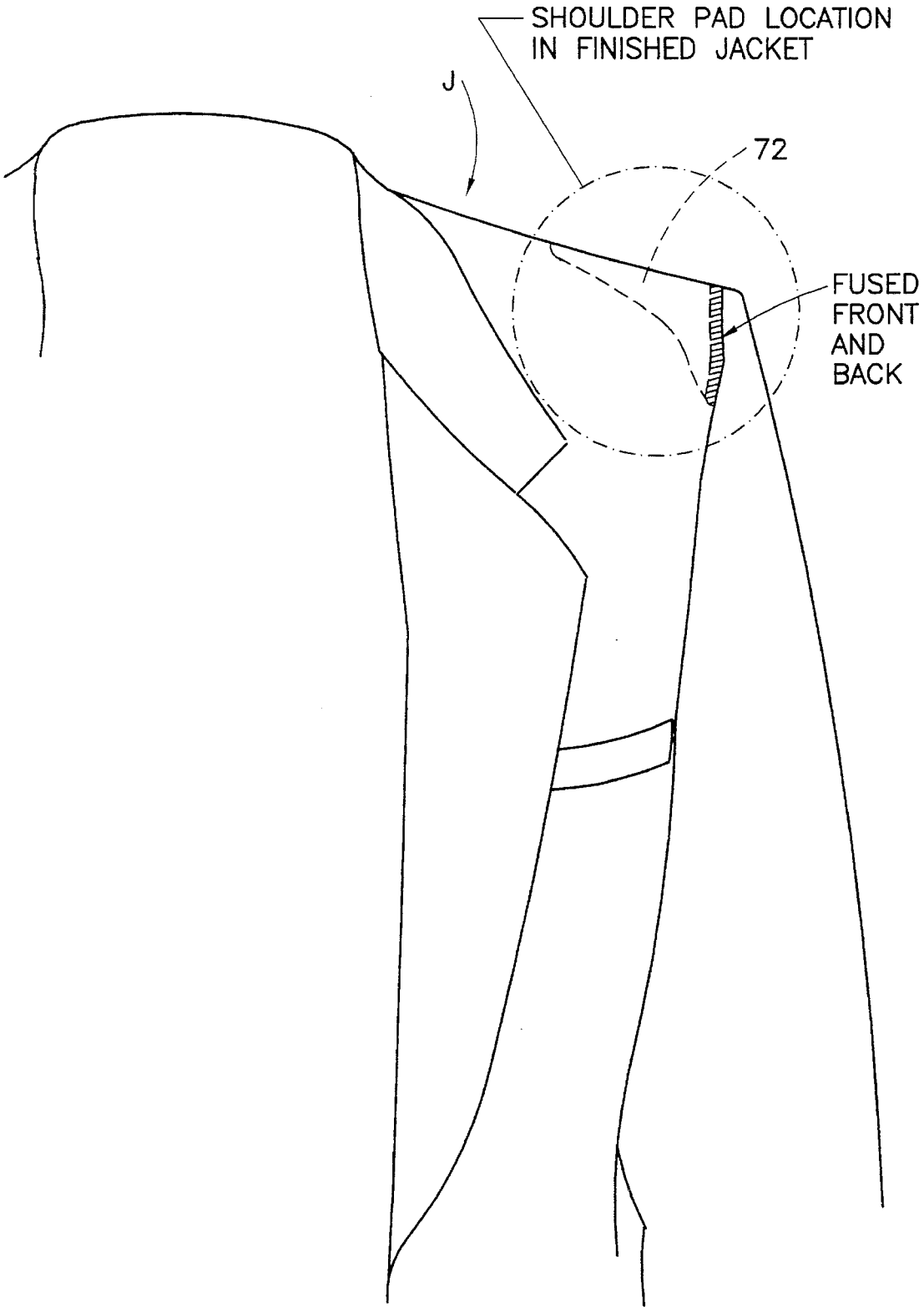
FIG. 6*a* shows a partial view of a jacket and showing the location of a shoulder pad of the type shown for example in FIG. 6 in a finished jacket.

FIG. 6*a* shows the proper position of a shoulder pad 72 within a garment such as, for example, a jacket J.

Figures 7, 7A:
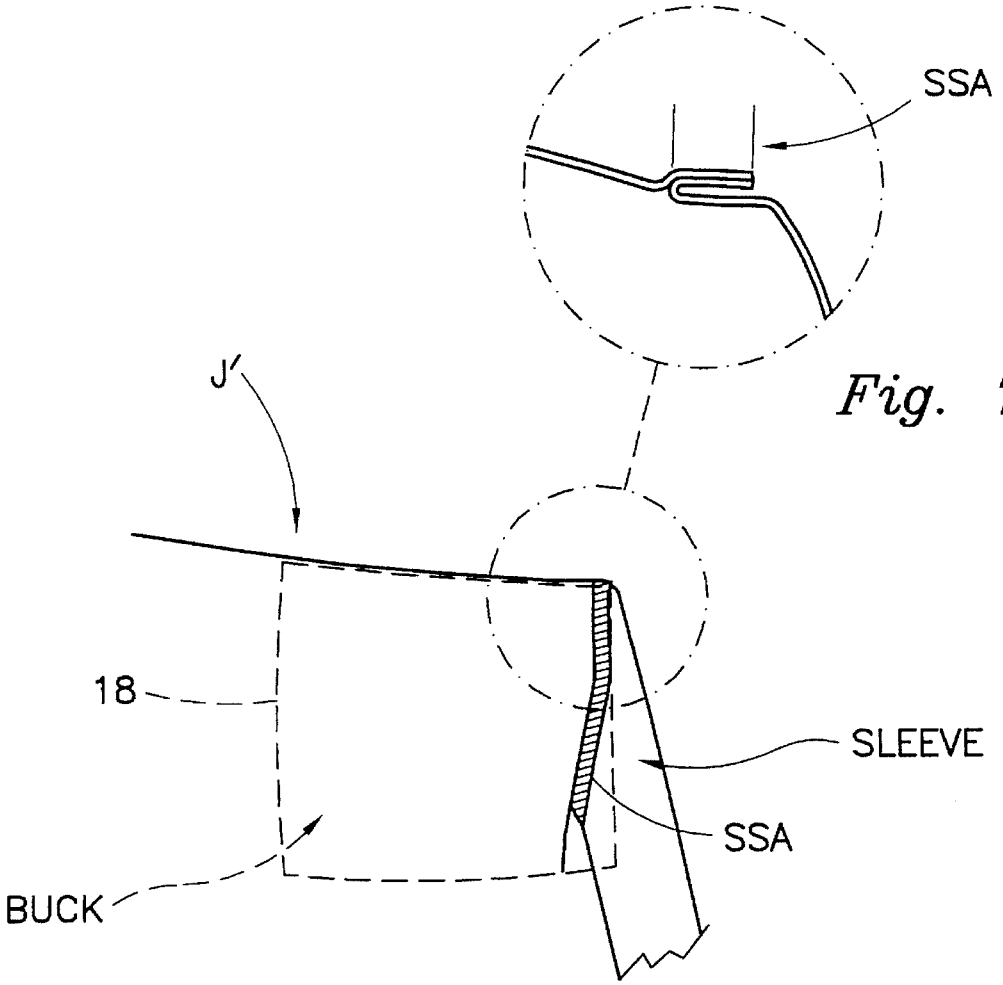
FIG. 7 shows a view of the sleeve seam allowance in a jacket, with the jacket shoulder portion shown turned inside out.
FIG. 7*a* shows an enlarged detailed view of the sleeve seam allowance in the garment of FIG. 7.

FIG. 7 shows a shoulder area of a jacket J' in which the shoulder has been turned inside out and is resting upon buck 18. The sleeve seam allowance SSA is shown in FIG. 7 and is shown in greater detail in FIG. 7*a*, and extends around the region where the shoulder portion of the jacket meets the upper portion of the sleeve. The sleeve seam allowance is typically of the order of ⅜ inch wide.

The manner in which the garment, such as a jacket, is prepared for application of a shoulder pad is as follows:

The garment such as jacket J' is turned inside out and is placed upon the buck 18 in the manner shown in FIG. 7. Buck 18 has a contoured shape which conforms to the desired shape of a shoulder. The buck is preferably covered with a thin pad (not shown for purposes of simplicity). Buck 18 is heated with live steam introduced through inlet tube 18*i*. Curved member 18*a* is heated by conduction, the steamed generated heat insuring that the padding on the buck remains dry.

A vacuum condition is drawn through tube 18*c*. The vacuum holes 18*b* enable the vacuum to hold the garment in proper position upon the buck. A standard two-sided fusible tape having a fusible on its major surfaces is employed. The tape is of the proper length and width to cooperate with and be aligned along the sleeve seam allowance described hereinabove. One of the major surfaces containing the fusible has a paper backing. The exposed major surface containing fusible is placed upon the garment and specifically upon the sleeve seam allowance (SSA). The apparatus of the present invention preferably places a fusible upon the area referred to as the shoulder seam allowance. This allowance, which is usually ⅜ of an inch, comprises the excess material beyond the stitch mark on the shoulder seam in a jacket. In present state of the art, shoulder pad fusing, unsightly impressions are created on the outside of the garment where the fusible is melted. Such impressions are completely avoided through the present invention since the tape is applied to an extra layer of material, which is not in contact with the exposed outside material of the garment thereby providing an attractive final product, which totally eliminates the unsightly impressions, which occur when employing conventional techniques.

As was mentioned hereinabove, the exposed fusible surface is placed along the shoulder seam allowance (SSA).

Figure 2:
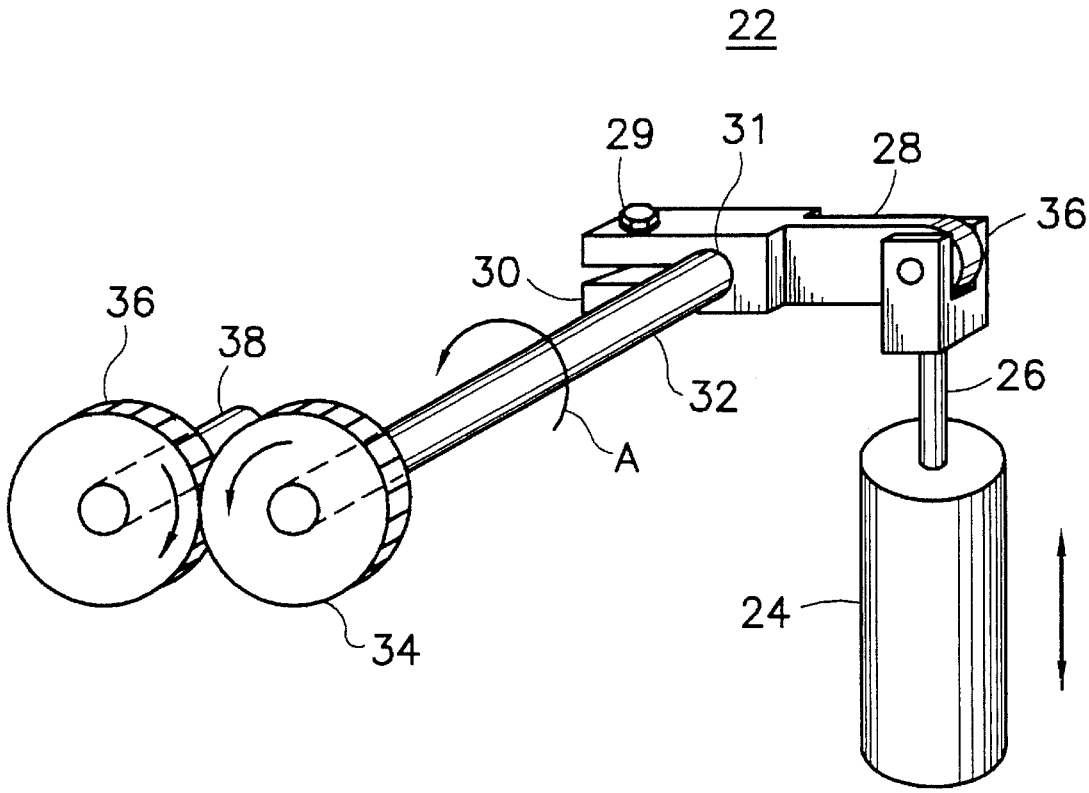
FIG. 2 shows a perspective view of the power transfer mechanism employed in the apparatus of FIG. 1.

The cylinder 24 is operated to rotate shaft 32 counter-clockwise as shown by arrow A in FIG. 2. This causes the pivot tube 44 mounted to shaft 32 to rotate counter-clockwise about shaft 32. Driven gear 34, which meshes with gear 36 causes shaft 38 to rotate clockwise swinging the pivot tube mounted thereto clockwise. The heads move from the positions 20, 20 to the positions 20', 20' shown in FIG. 1. The left gear 36 drives the right pressing head and the right gear drives the left pressing head, through their respective pivot tubes. The reversal of the gear-to-head drive connections allows apparatus 10 to make more effective use of space, especially when the pivot arms are in the up position. The pivot arms are symmetrical about centerline C and the offset of shafts 32 and 38 permits unobstructed movement of the head assemblies between the open and closed (i.e. "pressing") positions.

The only time the head assemblies of the machine require precise positioning is in the down position at which stage they are in contact with buck 18. Any play in the gear set 34, 36 is a factor only in the follower gear. The play can be adjusted out by setting the alignment ball thread 48 to the proper depth in member 46.

Each head is heated by way of a pressure chamber with line steam. The steam can be ejected from the head assemblies via holes 54*a* provided in the head pressing plate when working with those fusibles which require steam to activate the fusible.

Heads 20, 20 close at the same time which eliminates any distortion of the garment. The use of a pair of split heads assures the application a proper and uniform pressure to the jacket and the two-sided fusible strip. Single head machines are inefficient and impractical for tape application due to the contoured-shape. Machines with single pressing heads cannot apply uniform pressure to all areas where tape fusing is required. By providing a pair of heads that do not overlap and which line up end to end when they contact the buck 18, the distortion problems of conventional machines are eliminated. In addition, conventional two-headed machines require separate drive means. A single drive means reduces equipment costs and also reduces machine complexity and operating time.

After the exposed fusible surface has fused to the sleeve seam allowance, the heads are moved to the open position in readiness for receipt of the next jacket.

The completed jacket may then be placed upon a suitable shoulder pad fusing machine to complete the application of the shoulder pad to the garment, it being understood that the subsequent operation is beyond the scope of the present invention. Nevertheless, the present invention enables the use of inexpensive shoulder pads which do not have a fusible impregnated therein and which provide for proper and effective mounting of a shoulder pad in an inexpensive and efficient manner, as well as eliminating impressions created in the external surface of the garment when affixing a shoulder pad to a garment using a conventional technique.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Means for joining a fusible to a garment, comprising:

a support having a substantially rigid, curved, convex supporting surface for supporting a garment;

first and second pressing members each having a substantially rigid, curved, concave pressing surface, the shape of each pressing surface substantially respectively conforming in shape to first and second adjacent surface portions of said support surface of substantially equal surface areas;

first and second swingable pivot arms respectively supporting said first and second pressing members; and drive means for simultaneously swingably moving said pivot arms for moving each of said pressing members along respective first and second arcuate paths between a position displaced from said support and a compressing position urging a fusible against a garment on said support;

said pivot arms and said drive means collectively comprising engaging means for bringing each of said pressing members into engagement with said support so as to apply a pressure distributed substantially throughout the concave pressing surface of the pressing member to a fusible and a garment on said support, and alignment means for causing adjacent ends of said concave pressing surfaces of said pressing members to become aligned with each other, to touch each other, and to touch said support, all simultaneously with bringing each of said pressing members into engagement with said support, thereby preventing pinching or distortion of the fusible and the garment.

2. The joining means of claim 1, wherein the first and second pressing members each have a first edge transverse to its associated pressing surface;

the first edges of said first and second pressing members being adjacent to and substantially engaging one another only when the pressing members are in the compressing position.

3. The joining means of claim 1, wherein said fusible is a strip having a fusible material on a surface thereof for engagement with a surface of a garment placed on said support; and means for heating said support.

4. The joining means of claim 3, wherein the surface of said support engaging said garment is metallic, and is heated by conduction by said heating means to fuse said fusible material.

5. The joining means of claim 4 wherein said heating means comprises steam heating means.

6. The joining means of claim 3, wherein said first and second pressing members each include heating means for heating its associated pressing member to fuse the fusible material.

7. The joining means of claim 6 wherein said heating means comprises steam heating means.

8. The joining means of claim 3, wherein said support includes vacuum means for releaseably maintaining a garment in position on said support.

9. The joining means of claim 8, wherein said support surface is provided with a plurality of openings for communicating with said vacuum means.

10. The joining means of claim 3, wherein said support includes vacuum means for releaseably maintaining a garment and a pad upon said support.

11. The joining means of claim 3, wherein steam means is provided for said first and second pressing members for introducing steam into an interior of said first and second pressing members, said first and second pressing members each having openings in said pressing surfaces for emitting steam to heat and fuse said fusible material.

12. The joining means of claim 3, wherein the first and second pressing members pressing surfaces are formed of a metallic material, and heating means for heating said first and second pressing members whereby said pressing surfaces are heated by conduction.

13. The joining means of claim 1, wherein the shape of said support surface provides a shoulder of a garment arranged on said support with a shape which facilitates application of a fusible thereto.

14. The joining means of claim 13, wherein the garment is provided with a sleeve seam allowance;

said fusible comprising a strip having a fusible material on one surface thereof and arranged to overlay said sleeve seam allowance.

15. The joining means of claim 14 wherein said strip has a fusible material on an opposing surface and a protective sheet covering said opposing surface.

16. The joining means of claim 1, wherein said single drive means comprises a first and second rotatably mounted gears, each having gear teeth in meshing engagement;

means for rotating said first gear whereby rotation is imparted to said second gear through said meshing engagement;

each of said first and second gears being respectively mounted upon first and second rotatable shafts;

said first and second pivot arms respectively comprising:

first and second rod means for respectively coupling said first and second pressing members to an associated one of said rotatable shafts;

said first and second rods being arranged in a criss-cross manner when the pressing members are in the displaced position to reduce a separation distance between said pressing members in the displaced position.

17. The joining means of claim 16, wherein a joining end of said shaft is joined to an associated rod; and the joining ends of said shafts being displaced to enable unobstructed movement of said rods.

18. The joining means of claim 16, wherein the pressing members are arranged on opposite sides of a vertical plane passing through a center of said support whereby one of said pressing members lies to a right side of said plane and the other one of said pressing members lies to a left side of said plane;

said rotatable gears being arranged so that said first gear and its associated shaft lies to the right of said plane and said second gear and its associated shaft lies to the left of said plane;

said rod means being arranged so that one rod joins said left-hand pressing member to the shaft arranged to the right of said plane and the other rod joins the right-hand pressing member to the shaft arranged to the left of said plane.

19. The joining means of claim 18, wherein said gears are rotated so that the pressing member extending to the right of said plane, when in the displaced position, moves towards said plane when moved to the pressing position, and wherein the pressing member to the left of said plane when in the displaced position moves towards said plane when moved to the pressing position. .

20. The joining means of claim 19, further comprising cylinder means for rotating the drive gear.

21. The fusible joining means of claim 18 wherein said support is aligned so that left and right-hand ends thereof are substantially equidistant from said plane which extends through a center of said support.

22. The fusible joining means of claim 1 wherein said convex curved surface terminates at first and second ends spaced from one another;

said concave curved pressing surfaces each terminating at first and second ends spaced from one another;

a circumferential distance measured along each curved concave surface being approximately one-half of a circumferential distance measured along said curved convex surface.

23. The fusible joining means of claim 22 wherein said first arms are joined to their associated pressing members at a location intermediate the first and second ends thereof.

24. The fusible joining means of claim 23 wherein said location is equidistant from the first and second ends of the pressing member.

25. The fusible joining means of claim 22 wherein said support is maintained stationary at all times throughout a fusing operation.

26. The fusible joining means of claim 1 wherein said support has a substantially semi-cylindrical support surface; and each pressing member having a substantially cylindrical concave surface whose circumferential length is approximately one-half that of the semi-cylindrical surface.

27. The fusible joining means of claim 1 further comprising adjusting means for adjusting said pressing members to accommodate garments of different thicknesses.

28. The joining means of claim 1, wherein said drive means comprises single drive means.

29. The joining means of claim 1, wherein a tangent of the concave pressing surface of each of said pressing members is parallel to a corresponding tangent of said convex supporting surface just prior to engagement of said pressing members with said support.

30. The joining means of claim 1, wherein each of said first and second pivot arms moves about a fixed pivot point.

31. The joining means of claim 1, wherein each of said first and second pivot arms moves about a different pivot point.

32. The joining means of claim 1, wherein each of said first and second pivot arms moves about a pivot point which is located at a substantial distance from said support, the substantial distance being several times the radius of curvature of said supporting surface.

33. The joining means of claim 1, wherein said concave pressing surfaces of each of said first and second pressing members are substantially identical in shape and size to a corresponding portion of said supporting surface.

34. A fusible garment joining apparatus comprising:

a support having a substantially rigid, curved, convex supporting surface for supporting a garment;

first and second pressing members each having a substantially rigid, curved, concave pressing surface, the shape of each pressing surface substantially respectively conforming in shape to first and second adjacent surface portions of said support surface of substantially equal surface areas;

first and second swingable pivot arms respectively supporting said first and second pressing members; and a drive mechanism for simultaneously and swingably moving said pivot arms for moving each of said pressing members along respective first and second arcuate paths between a position displaced from said support and a compressing position urging a fusible against a garment on said support;

said pivot arms and said drive mechanism collectively comprising engaging means for bringing each of said pressing members into engagement with said support so as to apply a pressure distributed substantially throughout the concave pressing surface of each said pressing member to a fusible and a garment on said support, and alignment means for causing adjacent ends of said concave pressing surfaces of said pressing members to become aligned with each other, to touch each other, and to touch said support, all simultaneously with bringing each of said pressing members into engagement with said support, thereby preventing pinching or distortion of the fusible and the garment.

* * * * *